US012004693B1

(12) United States Patent
Lin

(10) Patent No.: US 12,004,693 B1
(45) Date of Patent: Jun. 11, 2024

(54) PAPER TOWEL HOLDER

(71) Applicant: Qiaolan Lin, Yongtai County, Fujian Province (CN)

(72) Inventor: Qiaolan Lin, Yongtai County, Fujian Province (CN)

( * ) Notice: Subject to any disclaimer, the term of this patent is extended or adjusted under 35 U.S.C. 154(b) by 0 days.

(21) Appl. No.: 18/401,660

(22) Filed: Jan. 1, 2024

(30) Foreign Application Priority Data

Nov. 29, 2023 (CN) ..... 202323263725.3

(51) Int. Cl.
*A47K 10/38* (2006.01)

(52) U.S. Cl.
CPC ..... *A47K 10/3836* (2013.01)

(58) Field of Classification Search
CPC ..... A47K 10/3836; B65H 2403/72; B65H 16/04; B65H 18/026
See application file for complete search history.

(56) References Cited

U.S. PATENT DOCUMENTS 7,124,976 B1 * 10/2006 DeVincenzo ..... B65H 23/06 242/597.1
7,140,573 B1 * 11/2006 Jerstroem ..... A47K 10/3836 242/597.6
7,328,869 B1 * 2/2008 Zies ..... A47K 10/3836 242/597.7
2006/0219837 A1 * 10/2006 Yang ..... A47K 10/3836 242/597.4
2007/0176043 A1 * 8/2007 Yu ..... A47K 10/3836 242/597.7
2010/0072343 A1 * 3/2010 Glover ..... A47K 10/40 242/597.7
2013/0248645 A1 * 9/2013 Miller ..... A47K 10/22 242/597.7

* cited by examiner

*Primary Examiner* — William A. Rivera
(74) *Attorney, Agent, or Firm* — Xiaofang Zhong

(57) ABSTRACT

A paper towel holder is provided, comprising: a support base; a support shaft, which is provided on the support base; a movable clamping body, which is sleeved on a first end of the support shaft, and is used to abut against a first end of the paper roll; a static clamping body, which is detachably arranged on a second end of the support shaft, and is used to abut against a second end of the paper roll; a first magnetic suction member, which is arranged on the movable clamping body; and a second magnetic suction member, which is arranged on a side proximate to the first end of the support shaft and further away from the static clamping body than the movable clamping body, wherein the second magnetic suction member and the first magnetic suction member repel each other so as to maintain the movable clamping body in a state of being held against the first end of the paper roll; or, the second magnetic suction member is arranged on a side proximate to the second end of the support shaft, the second magnetic suction member and the first magnetic suction member attract each other so as to maintain the movable clamping body in a state of being held against the first end of the paper roll. It allows the user to pull out the paper roll with one hand and avoids rattling during the process of pulling out the paper roll.

10 Claims, 7 Drawing Sheets

PAPER TOWEL HOLDER

TECHNICAL FIELD OF THE INVENTION

The present disclosure relates to the technical field of a holder, in particular to a paper towel holder.

BACKGROUND OF THE INVENTION

Paper towel holder is a bracket structure which is used to support the paper roll and is used for a rotation of the paper roll on the paper towel holder to realize the paper out; today's paper towel holder generally needs to be operated by both hands in order to pull the paper towel, the operation is more cumbersome, the use lacks convenience; some paper towel holders are provided with ratchet structure for one-handed pulling the paper towel, but in the process of one-handed pulling the paper towel, the ratchet structure due to the rolling with paper towel will produce a squeaky noise, the noise is loud and brings a poor user experience.

SUMMARY OF THE INVENTION

Embodiments of the present application provide a paper towel holder to solve the problems of the related technology, with the following technical solutions:

Embodiments of the present application provide a paper towel holder comprising:

a support base;

a support shaft, which is provided on the support base, and is used to rotatably cooperate with a center hole of a paper roll to support the paper roll and enable the paper roll to rotate around the support shaft;

a movable clamping body, which is movably sleeved on a first end of the support shaft along a length direction of the support shaft, and is used to abut against a first end of the paper roll;

a static clamping body, which is detachably arranged on a second end of the support shaft, and is used to abut against a second end of a paper roll;

a first magnetic suction member, which is arranged on the movable clamping body; and a second magnetic suction member, which is arranged on a side proximate to the first end of the support shaft and further away from the static clamping body than the movable clamping body, wherein the second magnetic suction member and the first magnetic suction member repel each other so as to maintain the movable clamping body in a state of being held against the first end of the paper roll; or, the second magnetic suction member is arranged on a side proximate to the second end of the support shaft, the second magnetic suction member and the first magnetic suction member are attracted each other so as to maintain the movable clamping body in a state of being held against the first end of the paper roll.

In one embodiment, the first magnetic suction member and the second magnetic suction member are both annular structures arranged around the support shaft.

In one embodiment, the second end of the support shaft has a socket, which extends along the length direction of the support shaft;

the static clamping body comprises an inserting portion, the inserting portion and the socket fit together to connect the static clamping body and the support shaft together.

In one embodiment, the support shaft is provided with a first snap portion, the first snap portion is arranged in the socket;

the inserting portion is provided with a second snap portion, the second snap portion and the first snap portion detachably snap together, the second snap portion and the first snap portion snap together to restrict the inserting portion from disengaging from the socket.

In one embodiment, the second snap portion is radially movably arranged on the inserting portion;

said static clamping body further comprises a static seat body having the inserting portion and a press-type drive structure movably arranged on the static seat body, the press-type drive structure is connected to the second snap portion, the press-type drive structure has a relaxation state and a pressing state, the second snap portion and the first snap portion are snapped together, when the press-type drive structure is in the relaxation state; the second snap portion and the first snap portion are disengaged, when the press-type drive structure is in the pressing state.

In one embodiment, the press-type drive structure comprises:

a press portion, which is radially movably arranged on the static seat body, the press portion and the second snap portion are connected;

a resilient member, which is arranged between the press portion and the static seat body, the resilient member is used to actuate the press portion to reset from the pressing state to the relaxation state.

In one embodiment, the paper towel holder further comprises a connecting cylinder, the connecting cylinder is inserted in the socket, an end of the connecting cylinder far away an outer end of the socket forms the first snap portion;

the second snap portion has a snap slot, the snap slot and the first snap portion are snapped together.

In one embodiment, the support shaft is provided with a position limiting structure, the position limiting structure and the movable clamping body abut against each other, to limit the movement of the movable clamping body in a direction proximate to the static clamping body.

In one embodiment, in case of that the second magnetic suction member is arranged on a side proximate to the first end of the support shaft and further away from the static clamping body than the movable clamping body, the first end of the support shaft is also provided with a fixing seat and the second magnetic suction member is arranged on the fixing seat;

or, in the case of that the second magnetic suction member is located on a side close to the second end of the support shaft, the second magnetic suction member is provided on the static clamping body.

In one embodiment, a side of the movable clamping body proximate to the static clamping body is provided with a first tapered portion, the first tapered portion has a cross-section that tapers in the direction proximate to the static clamping body, the first tapered portion is used to partly abut against the first end of the paper roll;

a side of the static clamping body proximate to the movable clamping body is provided with a second tapered portion, the second tapered portion has a cross-section that tapers in the direction proximate to the movable clamping body, the second tapered portion is used to partly abut against a second end of the paper roll.

Advantages or beneficial effects in the above-described technical solution include at least:

in the paper towel holder of the present disclosure, when loading the paper roll, the static clamping body can be removed from the support shaft, and then the support shaft can be inserted in the center hole of the paper roll from the second end of the support shaft, and then the static clamping body can be mounted on the second end of the support shaft, and the movable clamping body and the static clamping body clamp the paper roll and restrict the movement of the paper roll along the support shaft, so that there is no need to support the paper roll manually during the process of pulling out the paper roll, which can realize the pulling out of the paper roll by a single hand, and the pulling out operation of the paper roll is more convenient, and in the process of pulling the paper roll, the movable clamping body is subject to an effect of mutual repulsion or mutual attraction of the first magnetic suction member and the second magnetic suction member and cannot rotate relative to the support shaft, so that only the paper roll rotates, which can avoid abnormal noise, will not produce noise, and can provide users with a better user experience;

in addition, because the movable clamping body can move along the support shaft and is subjected to an effect of mutual repulsion or mutual attraction of the first magnetic suction member and the second magnetic suction member and maintains the state abutting against the paper roll, a force exerted to the paper roll by the movable clamping body is an elastic clamping force, to ensure that when the movement of the paper roll along the support shaft is limited, the paper roll can be rotated around the support shaft, when pulling the paper roll, to ensure that the paper out is smooth;

in addition, because the movable clamping body can move along the support shaft and is subjected to an effect of mutual repulsion or mutual attraction of the first magnetic suction member and the second magnetic suction member and maintains the state abutting against the paper roll, the distance between the movable clamping body and the static clamping body can be adjusted, which makes the paper towel holder can be suitable for different lengths of paper roll installed, so that it has a wide range of application, a versatility, and is more convenient to use;

in addition, during the process of installing the paper roll, the thrust force of the paper roll can be used to push the movable clamping body to move along the support shaft, so that the spacing or distance between the movable clamping body and the static clamping body can be automatically adapted to the corresponding length of the paper roll, which is simple to operate, convenient to adjust, and highly efficient to install.

The foregoing summary is for the purpose of the specification only and is not intended to be limiting in any way. In addition to the schematic aspects, embodiments and features described above, further aspects, embodiments and features of the present application will be readily understood by reference to the accompanying drawings and the following detailed description.

BRIEF DESCRIPTION OF THE DRAWINGS

In the accompanying drawings, unless otherwise specified, the same reference signs throughout the multiple accompanying drawings indicate the same or similar parts or elements. These accompanying drawings are not necessarily drawn to scale. It should be understood that these accompanying drawings depict only some of the embodiments disclosed in the present application and should not be viewed as limitation on the scope of the present application.

REFERENCE SIGNS IN THE FIGURES

Figure 1:
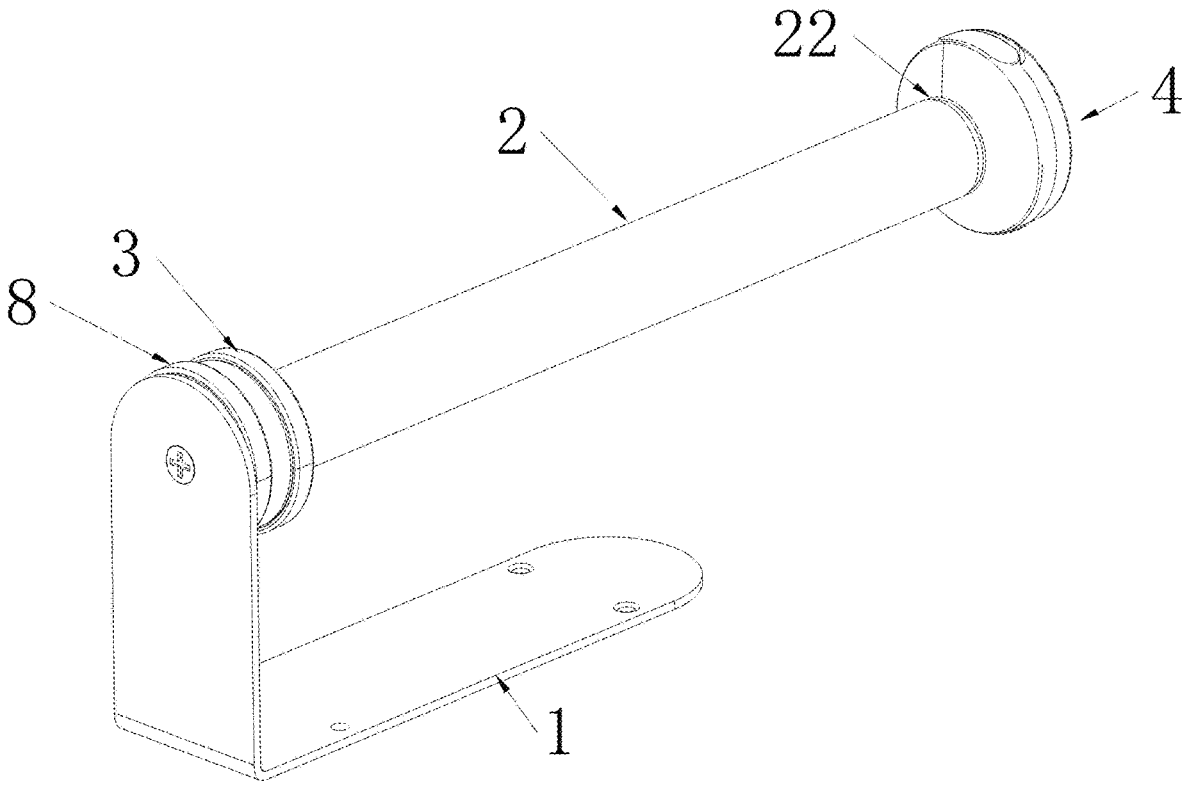
FIG. 1 shows a schematic diagram of the three-dimensional structure of the paper towel holder of the present disclosure.

1, a support base; 2, a support shaft; 21, a first end of the support shaft; 22, a second end of the support shaft; 23, a socket; 24, a position limiting structure; 3, a movable clamping body; 31, a movable seat body; 311, a first tapered portion; 32, a movable cover plate; 4, a static clamping body; 41, a static seat body; 411, an inserting portion; 412, a second tapered portion; 413, a guiding groove; 414, a mounting groove; 42, a static cover plate; 43, second snap portion; 431, snap slot; 44, press-type drive structure; 441, press portion; 442, resilient member; 5, first magnetic suction member; 6, second magnetic suction member; 7, connecting cylinder; 71, first snap portion; 72, snap-fit protrusion; 8, fixing seat; 81, fixing shell; 82, fixing cover.

DETAILED DESCRIPTION OF THE PREFERRED EMBODIMENT

In the following, only certain exemplary embodiments are briefly described. As can be recognized by those skilled in the art, the described embodiments can be modified in a variety of different ways without departing from the spirit or scope of the present application. Accordingly, the accompanying drawings and description are considered to be essentially exemplary and not limiting.

Referring to FIG. 1-FIG. 7, there is shown a paper towel holder of a preferred embodiment of the present disclosure, comprising:

A support base 1, which is configured to connect to an external support element, the external support element can be a tabletop, a wall, etc;

A support shaft 2, which is arranged on the support base 1, the support shaft 2 being used to rotatably cooperate with a center hole of a paper roll to support the paper roll and enable the paper roll to rotate around the support shaft 2;

A movable clamping body 3, the movable clamping body 3 being movably sleeved on a first end 21 of the support shaft 2 along a lengthwise direction of the support shaft 2, the movable clamping body 3 being used for abutting against the first end of the paper roll;

A static clamping body 4, the static clamping body 4 being detachably arranged on a second end 22 of the support shaft, the static clamping body 4 being used for abutting against the second end of the paper roll;

a first magnetic suction member 5, the first magnetic suction member 5 being arranged on the movable clamping body 3; and a second magnetic suction member 6, the second magnetic suction member 6 being arranged on a side proximate to the first end 21 of the support shaft and further away from the static clamping body 4 than the movable clamping body 3, in which case the second magnetic suction member 6 and the first magnetic suction member 5 repel each other, the first magnetic suction member 5 is subjected to repulsive force and exerts a thrust force on the movable clamping body 3 in a direction proximate to the static clamping body 4 to maintain the movable clamping body 3 in a state of being held against the first end of the paper roll; or the second magnetic suction member 6 is arranged on a side proximate to the second end 22 of the support shaft, in which case the second magnetic suction member 6 and the first magnetic suction member 5 are attracted to each other, and the first magnetic suction member 5 is subjected to magnetic suction force and exerts a tensile force in the direction proximate to the static clamping body 4 on the movable clamping body 3 so that the movable clamping body 3 maintains the state of being pressed against the first end of the paper roll.

With the paper towel holder of the present disclosure, the static clamping body 4 can be removed from the support shaft 2 during loading of the paper roll, and then the support shaft 2 can be inserted from the second end 22 of the support shaft into the center hole of the paper roll, and then the static clamping body 4 can be mounted on the second end 22 of the support shaft, and the paper roll can be restricted to move along the support shaft 2 by using the movable clamping body 3 and the static clamping body 4 to clamp the paper roll, so that there is no need to support the paper manually in pulling out the paper roll, and thus it is possible to Realize one-handed pulling the paper roll, the operation of pulling the paper roll is more convenient, and in the process of pulling the paper roll, the movable clamping body 3 is subjected to the effect of mutual repulsion or mutual attraction of the first magnetic suction member 5 and the second magnetic suction member 6 and will not rotate relative to the support shaft 2, so that only the paper roll can rotate, and thus it can avoid abnormal sound, and will not produce noise, and can provide the user with a better user experience;

In addition, because the movable clamping body 3 can move along the support shaft 2 and is subjected to the effect of mutual repulsion or mutual attraction of the first magnetic suction member 5 and the second magnetic suction member 6 and maintains the state of being pressed against the paper roll, so that the force exerted by the movable clamping body 3 to the paper roll is a resilient clamping force, to ensure that the paper roll can be rotated around the support shaft 2 during pulling the paper roll and the paper is smoothly discharged, when the movement of the paper roll along the support shaft 2 can be limited.

In addition, because the movable clamping body 3 can move along the support shaft 2 and is subjected to the effect of mutual repulsion or mutual attraction of the first magnetic suction member 5 and the second magnetic suction member 6 and maintains the state of being pressed against the paper roll, so that the distance between the movable clamping body 3 and the static clamping body 4 can be adjusted, and then the paper towel holder can be suitable for installing different lengths of paper roll, has a wide range of applications and versatility, and is more convenient to use.

In addition, in the process of installing the paper roll, the thrust force of the paper roll can be used to push the movable clamping body 3 to move along the support shaft 2, so that the distance between the movable clamping body 3 and the static clamping body 4 can be automatically adapted to the corresponding length of the paper roll, which is simple to operate, convenient to adjust, and highly efficient to install.

Referring to FIG. 1, the support base 1 includes a transverse connection portion and a vertical connection portion, the transverse connection portion and the support shaft 2 are parallel, the transverse connection portion is used to connect with an external support, one end of the vertical connection portion is connected to one end of the transverse connection portion, and another end of the vertical connection portion is connected to the first end of the support shaft 2.

Of course, in other embodiments, the support base 1 can be a base provided at the first end of the support shaft 2, so that the present paper towel holder is formed as a vertical structure.

Figure 3:
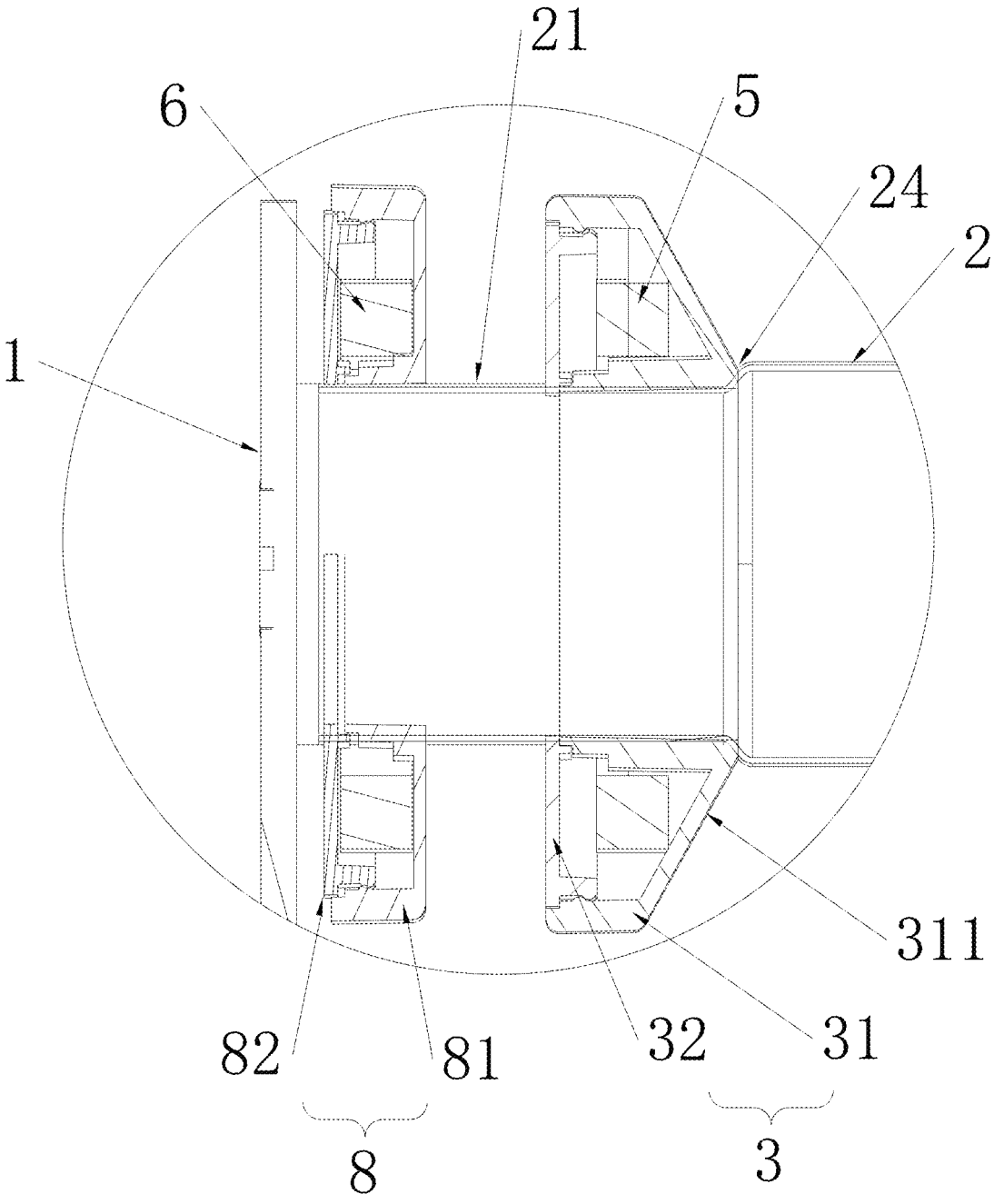
FIG. 3 shows a partially enlarged view at A in FIG. 2.

Referring to FIG. 3, in one embodiment, the first magnetic suction member 5 and the second magnetic suction member 6 are both annular structures set around the support shaft 2, so that the surface area of the first magnetic suction member 5 and the second magnetic suction member 6 is large enough to enhance the mutual repulsion or mutual attraction of the first magnetic suction member 5 and the second magnetic suction member 6, and thus the movable clamping body 3 can reliably maintain the state of being pressed against the first end of the paper roll, with higher structural reliability.

Of course, in other embodiments, the first magnetic suction member 5 and the second magnetic suction member 6 can include a plurality of magnetic suction blocks, the plurality of magnetic suction blocks are uniformly arranged around the support shaft 2, the use of this structure can also realize that the movable clamping body 3 can reliably maintain the state of being pressed against the first end of the paper roll.

Of course, in other embodiments, the first magnetic suction member 5 and the second magnetic suction member 6 can have a suitable shape such as rectangular or special-shaped.

Figure 4:
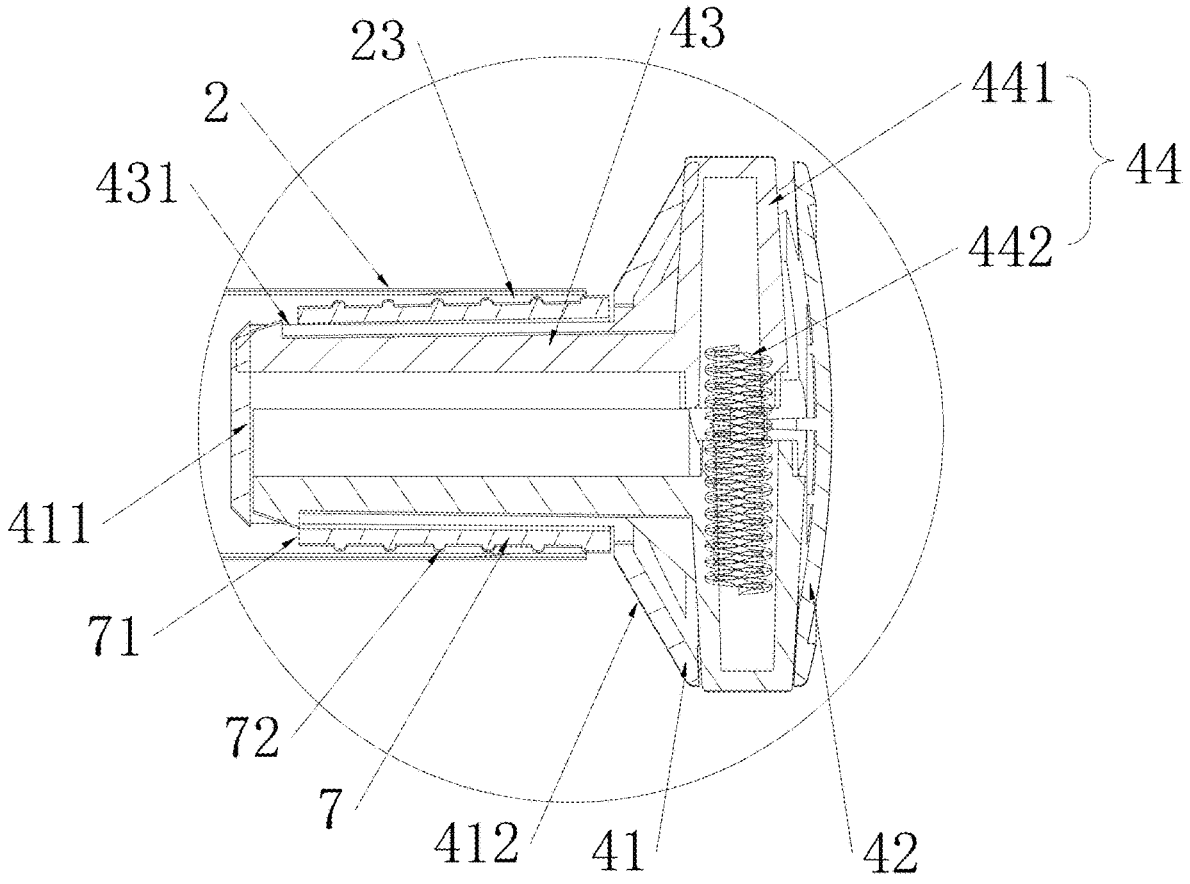
FIG. 4 shows a partially enlarged view at B in FIG. 2.

Referring to FIG. 4, in one embodiment, the second end 22 of the support shaft has a socket 23, the socket 23 extends along the length of the support shaft 2.

The static clamping body 4 comprises an inserting portion 411, wherein the inserting portion 411 and the socket 23 are connected and fitted together by Plug-in connection to connect the static clamping body 4 to the support shaft 2. That is, the static clamping body 4 is detachably connected to the support shaft 2 by means of Plug-in connection, with a simple and practical structure and a low cost, wherein, when installing, the inserting portion 411 of the static clamping body 4 is inserted in the socket 23 of the support shaft 2 to complete the installation, which is easy to install and has a high installation efficiency, and when disassembling, the inserting portion 411 can be detached from the socket 23 by means of pulling the static clamping body 4 in an outward direction far away from the second end 22 of the support shaft, which is convenient and efficient.

In one embodiment, the inserting portion 411 and the socket 23 are interference fit to reliably connect the inserting portion 411 and the socket 23 together.

Referring to FIG. 4, in one embodiment, the inserting portion 411 and the socket 23 are gap fit The support shaft 2 is provided with a first snap portion 71, wherein the first snap portion 71 is arranged in the socket 23.

The inserting portion 411 is provided with a second snap portion 43, the second snap portion 43 and the first snap portion 71 are detachably snapped and fastened, and the second snap portion 43 and the first snap portion 71 are fastened to restrict the inserting portion 411 from being detached from the socket 23, i.e., by using of that the second snap portion 43 and the first snap portion 71 are fastened, the inserting portion 411 and the socket 23 are reliably connected together, so that the connection stability of the inserting portion 411 and the socket 23 can be improved to ensure that the static clamping body 4 will not be detached from the support shaft 2 during the pulling of the paper roll, and the structural reliability is higher.

Referring to FIG. 4, in one embodiment, the second snap portion 43 is radially movably arranged on the inserting portion 411, so that the second snap portion 43 can be moved along a radial direction of the support shaft 2.

The static clamping body 4 further comprises a static seat body 41 having the above-described inserting portion 411 and a press-type drive structure 44 movably arranged on the static seat body 41, the press-type drive structure 44 is connected to the second snap portion 43, the press-type drive structure 44 has a relaxation state and a pressing state, the second snap portion 43 and the first snap portion 71 are snapped together when the press-type drive structure 44 is in the relaxation state, and when the press-type drive structure 44 is in the pressing state, the second snap portion 43 and the first snap portion 71 are disengaged. In other words, by pressing the press-type drive structure 44, the press-type drive structure 44 can be switched from the relaxation state to the pressing state, thereby disengaging the second snap portion 43 and the first snap portion 71, so that the inserting portion 411 can be easily removed from the socket 23, making the disassembly less difficult and more convenient, and by relaxing the press-type drive structure 44, the press-type drive structure 44 can be switched from the pressing state to the relaxation state, so that the second snap portion 43 and the first snap portion 71 can snap together to reliably connect the inserting portion 411 and the socket 23, which makes the installation more convenient and highly efficient.

Of course, in other embodiments, there is no need to provide a press-type drive structure 44, and the snapping of the first snap portion 71 and the second snap portion 43 can be unlocked with the pulling of the static clamping body 4 along an outward-facing direction far away from the second end 22 of the support shaft.

Figure 7:
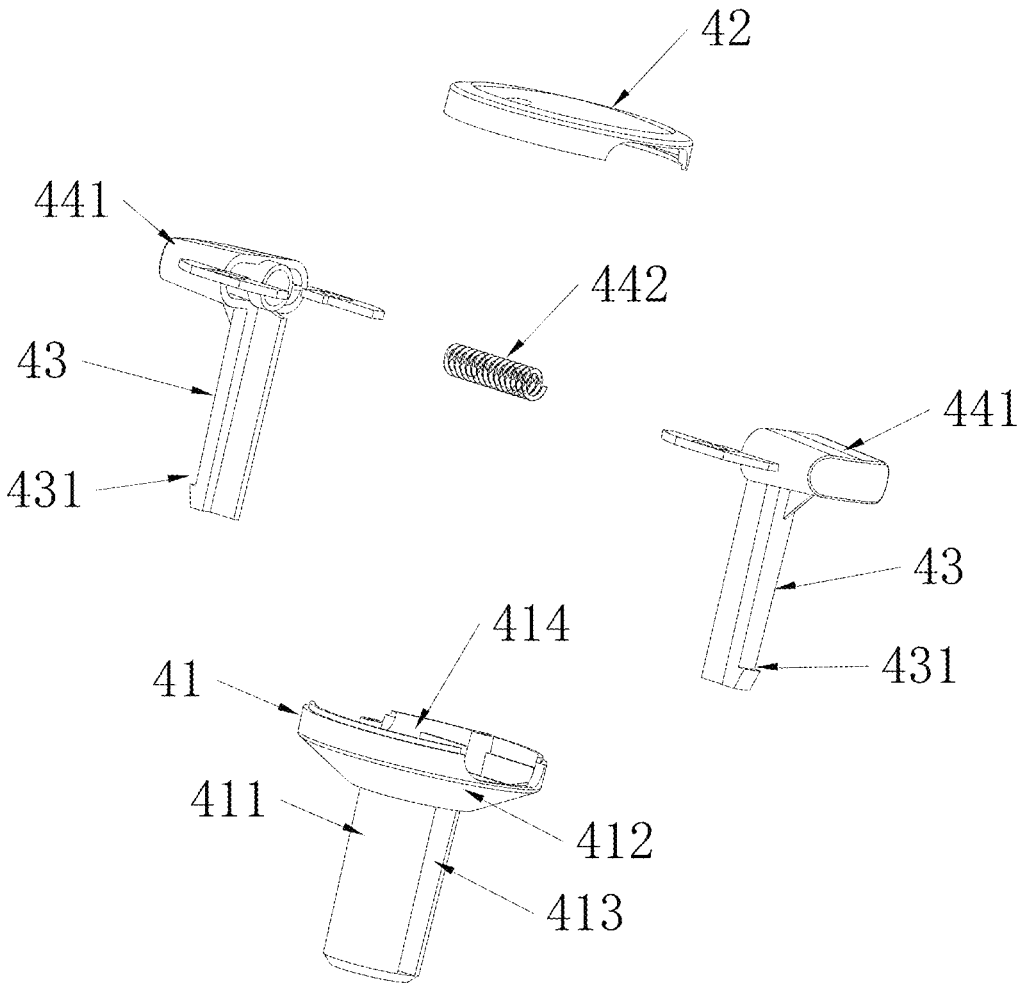
FIG. 7 shows an exploded view of the static clamping body of the present disclosure.

Referring to FIG. 4 and 7, in one embodiment, the press-type drive structure 44 comprises: a press portion 441, the press portion 441 is radially movably arranged on the static seat body 41, so that the press portion 441 can be moved along a radial direction of the support shaft 2, the press portion 441 is connected to the second snap portion 43;

a resilient member 442, the resilient member 442 is provided between the press portion 441 and the static seat body 41, and the resilient member 442 is used to actuate the press portion 441 to reset from the pressing state to the relaxation state; since the press portion 441 moves in the radial direction, that is, in the same direction as the second snap portion 43, the moving stroke is short, and can be realized using a simpler structure, so that it can simplify the overall structure of the static clamping body 4, and thus can reduce the cost, and at the same time, the press-type drive structure 44 is highly reliable and convenient to operate, and can provide a better user experience.

In one embodiment, the resilient member 442 is a spring, of course, in other embodiments, the resilient member 442 can also be an elastic structure such as a shrapnel.

Referring to FIG. 7, in one embodiment, the inserting portion 411 is provided with a guiding groove 413, the guiding groove 413 passes through an outer peripheral wall of the inserting portion 411, and the second snap portion 43 is movably inserted into the guiding groove 413 to be able to guide the movement of the second snap portion 43, so as to make the movement of the second snap portion 43 smoother, and the pressing operation smoother.

Figure 6:
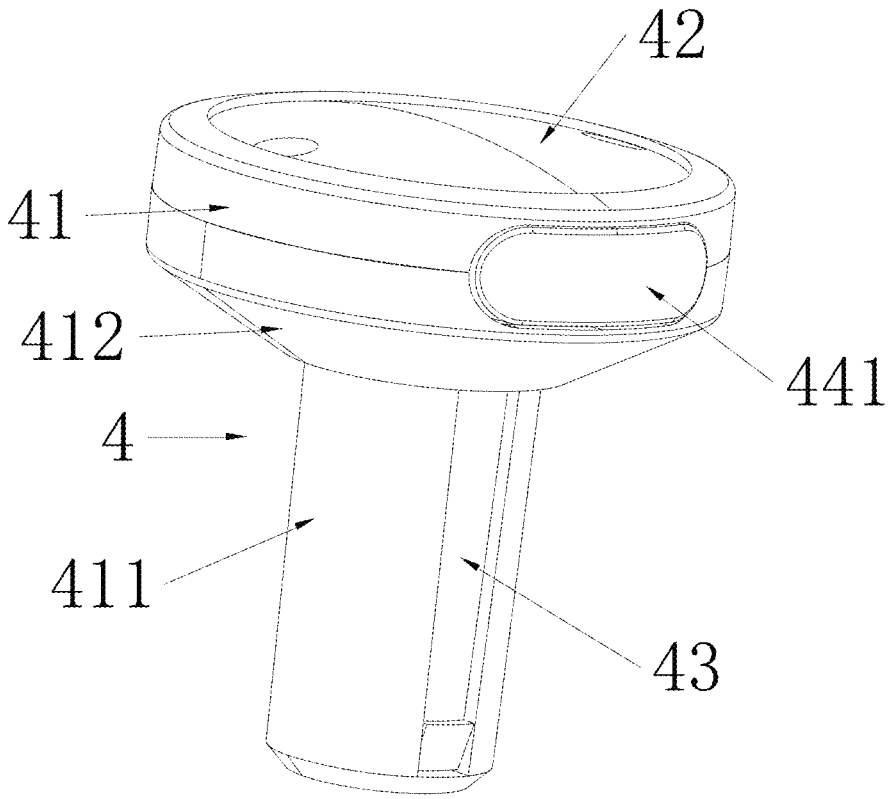
FIG. 6 shows a schematic diagram of the three-dimensional structure of the static clamping body of the present disclosure.

Referring to FIG. 6-FIG. 7, the number of the second snap portion 43 and the press-type drive structure 44 are two respectively, the two second snap portion 43 are arranged on opposite sides of the inserting portion 411, the second snap portions 43 are snapped with the first snap portion 71 to improve the stability of the connection between the inserting portion 411 and the socket 23, and the respective press-type drive structure 44 is connected to the corresponding second snap portion 43 to drive each second snap portion 43 to move independently.

Referring to FIG. 6-FIG. 7, to facilitate installation of the press portion 441, the resilient member 442 and the second snap portion 43, the static seat body 41 has a mounting groove 414 and a mounting opening, the press portion 441, the resilient member 442 and the second snap portion 43 are mounted in the mounting groove 414, the mounting opening and the mounting groove 414 are connected, the press portion 441, the resilient member 442 and the second snap portion 43 enter and exit the mounting groove 141 through the mounting opening, the static clamping body 4 further includes a static cover plate 42, the static cover plate 42 is arranged over the static seat body 41 and covers the mounting opening to restrict the press portion 441, the resilient member 442 and the second snap portion 43 from disengaging from the mounting groove 414.

Figure 5:
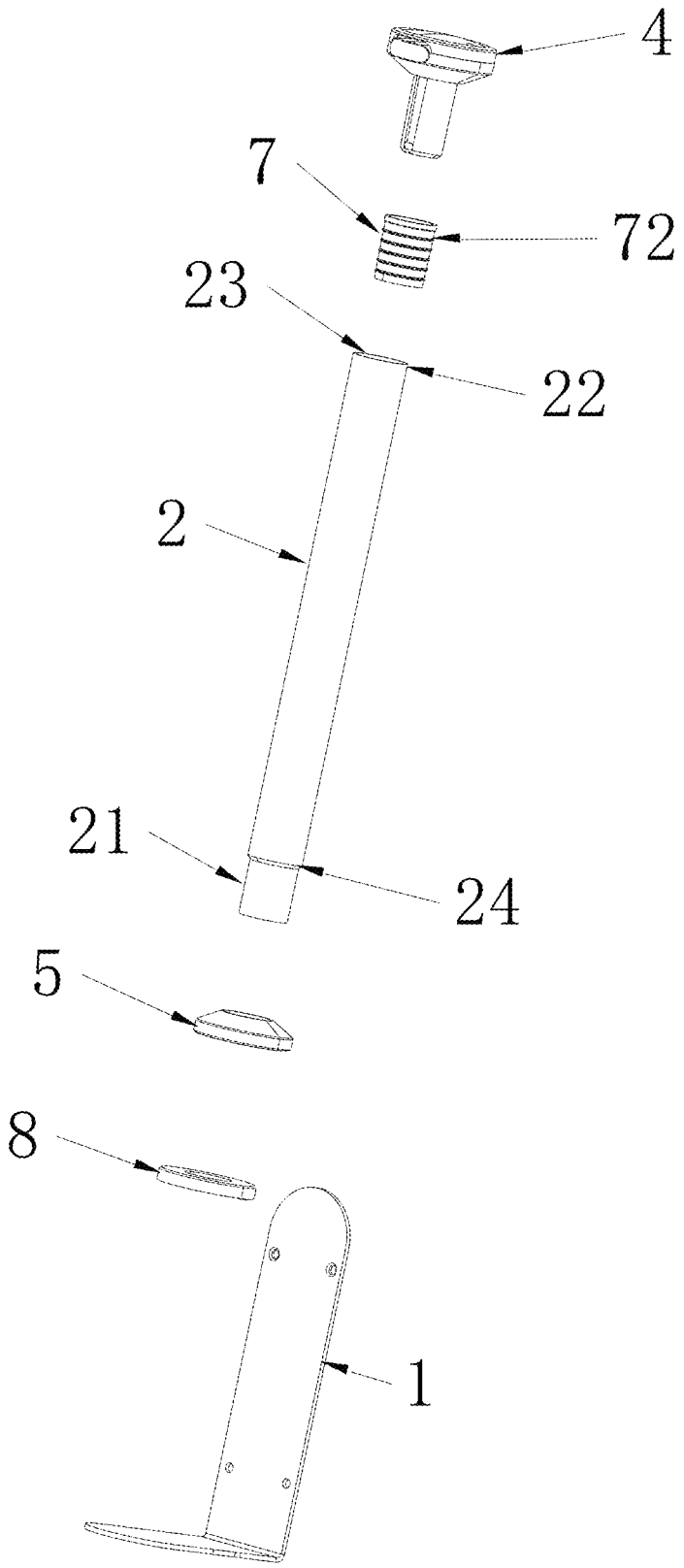
FIG. 5 shows an exploded view of the paper towel holder of the present disclosure.

Referring to FIG. 4-FIG. 5, in one embodiment, the paper towel holder further comprises a connecting cylinder 7, the connecting cylinder 7 is inserted in the socket 23, an end of the connecting cylinder 7 far from the outer end of the socket 23 forms a first snap portion 71, and the inserting portion 411 is inserted in a center hole of the connecting cylinder 7 to cooperate each other.

The second snap portion 43 has a snap slot 431, the snap slot 431 and the first snap portion 71 snap together. That is, the first snap portion 71 is located on the connecting cylinder 7, which is separated to the support shaft 2, the use of this structure can reduce the processing difficulty of the support shaft 2, which is conducive to reducing the cost, at the same time, because the first snap portion 71 is a end of the connecting cylinder 7, and the second snap portion 43 has a snap slot 431, by means of that the snap slot 431 and a end of the connecting cylinder 7 are connected, the first snap portion 71 and the second snap portion 43 can snap together reliably, so that the structure is simple and practical, with high reliability and low cost.

Referring to FIG. 4-FIG. 5, a plurality of annular snap-fit protrusions 72 are provided on an outer peripheral wall of the connecting cylinder 7, the plurality of annular snap-fit protrusions 72 are spaced apart along the length direction of the connecting cylinder 7, and in the case of the connecting cylinder 7 being inserted in the socket 23, the annular snap-fit protrusions 72 are pressed against the socket hole wall of the socket 23, so that the connecting cylinder 7 is snapped tightly in the socket 23, and the connecting cylinder 7 is reliably mounted in the socket 23.

Referring to FIG. 3 and 5, in one embodiment, the support shaft 2 is provided with a position limiting structure 24, the position limiting structure 24 and the movable clamping body 3 are pressed against each other to restrict the movable clamping body 3 from moving in a direction close to the static clamping body 4, and to be able to locate the movable clamping body 3, so that, after removing the static clamping body 4 from the second end 22 of the support shaft, the movable clamping body 3 is always fitted to the support shaft 2 to avoid that the movable clamping body 3 is disengaged from the support shaft 2, thereby avoiding the step of mounting the movable clamping body 3 when loading a paper roll, and making the operation more convenient.

In one embodiment, the outer diameter of the first end 21 of the support shaft is smaller than the outer diameter of the rest of the support shaft 2 to form the position limiting structure 24, i.e., the position limiting structure 24 is an end face arranged between the first end 21 of the support shaft and the rest of the support shaft 2, so that the structure is simple and practical with low cost.

In one embodiment, the end portion of the first end 21 of the support shaft and the support base 1 are connected together, and the support base 1 and the position limiting structure 24 limit the detachment of the movable clamping body 3 from the support shaft 2.

Referring to FIG. 1 and 3, in one embodiment, in case of that the second magnetic suction member 6 is located on a side close to the first end 21 of the support shaft and further away from the static clamping body 4 than the movable clamping body 3, the first end 21 of the support shaft is further provided with a fixing seat 8, on which the second magnetic suction member 6 is provided. That is, the fixing seat 8 serves as a mounting base for the second magnetic suction member 6 to facilitate fixing of the second magnetic suction member 6.

Referring to FIG. 3, in one embodiment, the first magnetic suction member 5 is arranged inside the movable clamping body 3 to reliably install the first magnetic suction member 5 on the movable clamping body 3 and avoid the first magnetic suction member 5 from detaching from the movable clamping body 3.

Referring to FIG. 3, to facilitate installation of the first magnetic suction member 5, the movable clamping body 3 comprises a movable seat body 31 and a movable cover plate 32, the movable seat body 31 and the movable cover plate 32 are connected, and the movable seat body 31 and the movable cover plate 32 enclose a mounting cavity accommodating the first magnetic suction member 5.

Referring to FIG. 3, in one embodiment, the second magnetic suction member 6 is arranged inside the fixing seat 8 to reliably mount the second magnetic suction member 6 on the fixing seat 8 and to avoid the second magnetic suction member 6 from detaching from the fixing seat 8.

Referring to FIG. 3, to facilitate installation of the second magnetic suction member 6, the fixing seat 8 comprises a fixing shell 81 and a fixing cover 82, the fixing shell 81 and the fixing cover 82 are connected, and the fixing shell 81 and the fixing cover 82 enclose a mounting cavity accommodating the second magnetic suction member 6.

In one embodiment, in case of that the second magnetic suction member 6 is located on a side close to the second end 22 of the support shaft, the second magnetic suction member 6 is provided on the static clamping body 4, i.e. the static clamping body 4 serves as a mounting base of the second magnetic suction member 6, in order to facilitate the mounting of the second magnetic suction member 6.

Figure 2:
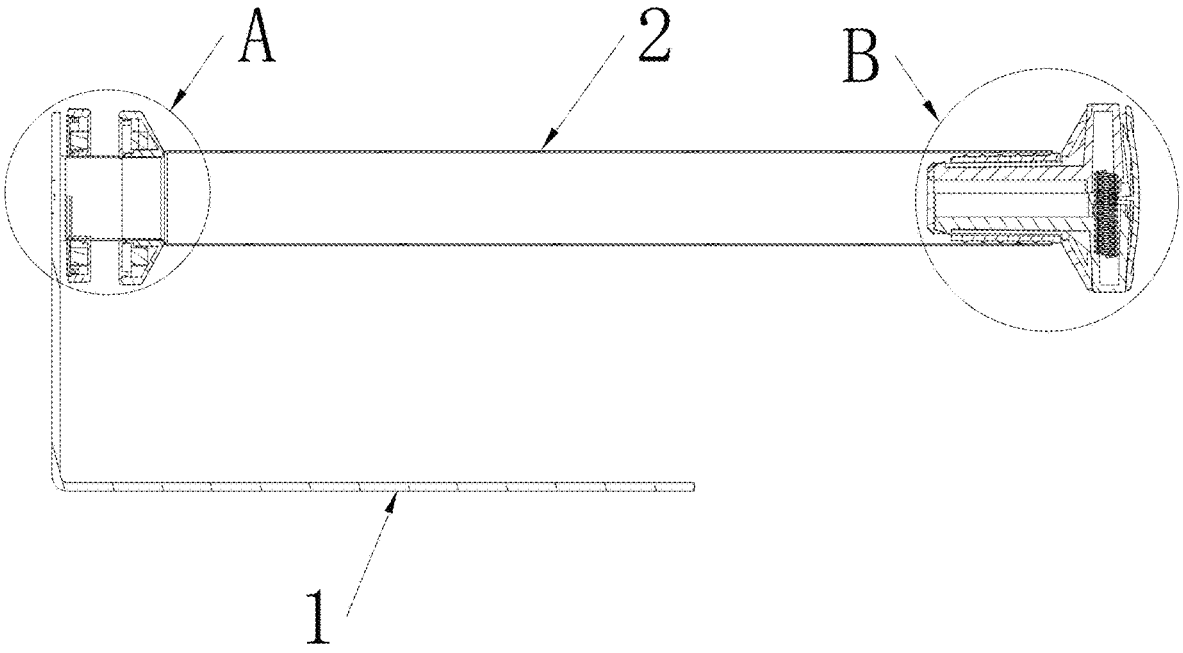
FIG. 2 shows a cross-sectional view of the paper towel holder of the present disclosure.

Referring to FIG. 2-FIG. 4, in one embodiment, a side of the movable clamping body 3 close to the static clamping body 4 is provided with a first tapered portion 311, the first tapered portion 311 has a cross-section which is gradually reduced in the direction of proximity to the static clamping body 4, and the first tapered portion 311 is used to partially abut against a first end of the paper roll, in order to reduce a contact area between the movable clamping body 3 and the paper roll, and thus reduce a thrust force acting on the paper roll by the movable clamping body 3, ensuring that the paper roll can be pulled and turned.

A side of the static clamping body 4 close to the movable clamping body 3 is provided with a second tapered portion 412, the cross-section of the second tapered portion 412 is gradually reduced in the direction close to the movable clamping body 3, and the second tapered portion 412 is used to partially abut against the second end of the paper roll, so as to reduce the contact area between the static clamping body 4 and the paper roll, thereby reducing the thrust force of the static clamping body 4 acting on the paper roll, and ensuring that the paper roll can be pulled and rotated.

In the description of the present specification, the description with regard to the terms "an embodiment", "some embodiments", "example", "specific example" or "some examples" means that the specific features, structures, materials, or characteristics described in conjunction with the embodiments or examples are included in at least one embodiment or example of the present application. Moreover, the described specific features, structures, materials or characteristics can be combined in any one or more of the embodiments or examples in a suitable manner. Moreover, without contradicting each other, those skilled in the art can combine and associate different embodiments or examples and features of different embodiments or examples described herein.

Furthermore, the terms "first" and "second" are used only for descriptive purposes and are not to be understood as indicating or implying relative importance or implicitly specifying the number of technical features indicated. Thus, a feature defined with the terms "first", "second" can expressly or impliedly include at least one such feature. In the description of the present application, "more than one" or "a plurality of" means two or more, unless otherwise expressly and specifically limited.

The above are only specific embodiments of the present application, but the scope of protection of the present application is not limited thereto, and any person skilled in the art can easily think of various variations or substitutions thereof within the scope of the technology disclosed in the present application, all of which shall be covered by the scope of protection of the present application. Therefore, the scope of protection of this application shall be subject to the scope of protection of the claims.

The invention claimed is:

1. A paper towel holder, comprising:

a support base;

a support shaft, which is provided on the support base, and is used to rotatably cooperate with a center hole of a paper roll to support the paper roll and enable the paper roll to rotate around the support shaft;

a movable clamping body, which is movably sleeved on a first end of the support shaft along a length direction of the support shaft, and is used to abut against a first end of the paper roll;

a static clamping body, which is detachably arranged on a second end of the support shaft, and is used to abut against a second end of the paper roll;

a first magnetic suction member, which is arranged on the movable clamping body; and a second magnetic suction member, which is arranged on a side proximate to the first end of the support shaft and further away from the static clamping body than the movable clamping body, wherein the second magnetic suction member and the first magnetic suction member repel each other so as to maintain the movable clamping body in a state of being held against the first end of the paper roll; or, the second magnetic suction member is arranged on a side proximate to the second end of the support shaft, the second magnetic suction member and the first magnetic suction member attract each other so as to maintain the movable clamping body in a state of being held against the first end of the paper roll.

2. The paper towel holder according to claim 1, wherein the first magnetic suction member and the second magnetic suction member are both annular structures arranged around the support shaft.

3. The paper towel holder according to claim 1, wherein the second end of the support shaft has a socket, which extends along the length direction of the support shaft;

the static clamping body comprises an inserting portion, the inserting portion and the socket fit together to connect the static clamping body and the support shaft together.

4. The paper towel holder according to claim 3, wherein the support shaft is provided with a first snap portion, the first snap portion is arranged in the socket;

the inserting portion is provided with a second snap portion, the second snap portion and the first snap portion are detachably snapped together, the second snap portion and the first snap portion are snapped together to restrict the inserting portion from disengaging from the socket.

5. The paper towel holder according to claim 4, wherein the second snap portion is radially movably arranged on the inserting portion;

said static clamping body further comprises a static seat body having the inserting portion and a press-type drive structure movably arranged on the static seat body, the press-type drive structure is connected to the second snap portion, the press-type drive structure has a relaxation state and a pressing state, the second snap portion and the first snap portion are snapped together, when the press-type drive structure is in the relaxation state; the second snap portion and the first snap portion are disengaged, when the press-type drive structure is in the pressing state.

6. The paper towel holder according to claim 5, wherein the press-type drive structure comprises:

a press portion, which is radially movably arranged on the static seat body, the press portion and the second snap portion are connected;

a resilient member, which is arranged between the press portion and the static seat body, the resilient member is used to drive the press portion to reset from the pressing state to the relaxation state.

7. The paper towel holder according to claim 4, wherein the paper towel holder further comprises a connecting cylinder, the connecting cylinder is inserted in the socket, an end of the connecting cylinder far away an outer end of the socket forms the first snap portion;

the second snap portion has a snap slot, the snap slot and the first snap portion are snapped together.

8. The paper towel holder according to claim 1, wherein the support shaft is provided with a position limiting structure, the position limiting structure and the movable clamping body abut against each other, to limit a movement of the movable clamping body in a direction proximate to the static clamping body.

9. The paper towel holder according to claim 1, wherein in case of that the second magnetic suction member is arranged on a side proximate to the first end of the support shaft and further away from the static clamping body than the movable clamping body, the first end of the support shaft is also provided with a fixing seat and the second magnetic suction member is arranged on the fixing seat;

or, in the case of that the second magnetic suction member is located on a side close to the second end of the support shaft, the second magnetic suction member is provided on the static clamping body.

10. The paper towel holder according to claim 1, wherein a side of the movable clamping body proximate to the static clamping body is provided with a first tapered portion, the first tapered portion has a cross-section that tapers in the direction proximate to the static clamping body, the first tapered portion is used to partly abut against the first end of the paper roll;

a side of the static clamping body proximate to the movable clamping body is provided with a second tapered portion, the second tapered portion has a cross-section that tapers in the direction proximate to the movable clamping body, the second tapered portion is used to partly abut against a second end of the paper roll.

* * * * *